US007467450B2

(12) United States Patent
Rygol et al.

(10) Patent No.: US 7,467,450 B2
(45) Date of Patent: Dec. 23, 2008

(54) BOOK BLOCK TRANSPORT SYSTEM

(75) Inventors: Dirk Rygol, Osnabruck (DE); Christoph von Freden, Schwaforden (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 11/700,988

(22) Filed: Feb. 1, 2007

(65) Prior Publication Data

US 2007/0187885 A1 Aug. 16, 2007

(30) Foreign Application Priority Data

Feb. 16, 2006 (DE) ..... 10 2006 007 104
Feb. 23, 2006 (DE) ..... 10 2006 008 452

(51) Int. Cl.
*B42C 19/08* (2006.01)

(52) U.S. Cl. ..... 29/33 K; 29/407.01; 270/58.08; 412/9; 198/621.1

(58) Field of Classification Search ..... 29/407.01, 29/281.1, 603.3, 243.54, 56.5, 428, 700, 29/405, 843, 740, 879, 33 K, 26 A, 793, 596, 29/605; 270/52.18, 52.16, 32, 33, 58.08, 270/37; 412/8, 9, 22, 38, 40, 33, 16, 19, 412/36, 37; 198/468.2, 464.2, 621.1, 441
See application file for complete search history.

(56) References Cited

U.S. PATENT DOCUMENTS 4,231,466 A * 11/1980 Rathert ..... 198/803.7
4,467,912 A * 8/1984 Rathert ..... 198/803.7
4,507,036 A * 3/1985 Rathert ..... 412/9
5,080,217 A * 1/1992 Garlichs et al. ..... 198/735.3
5,658,111 A * 8/1997 Rathert ..... 412/30

(Continued)

FOREIGN PATENT DOCUMENTS

DE 24 58 543 C2 6/1976

(Continued)

OTHER PUBLICATIONS

Search Report for German Application No. 10 2006 008 452.7.

*Primary Examiner*—Dana Ross
(74) *Attorney, Agent, or Firm*—Alix, Yale & Ristas, LLP

(57) ABSTRACT

A book block transport system with a plurality of book block clamps (1) each having a supporting frame (2) that is supported in guides and carries an inner clamping jaw (3) and a pivot frame (4) that is suspended on a shaft (6) of the supporting frame (2) extending parallel thereto for accommodating an outer clamping jaw (5). The pivoting movement for opening and closing the outer clamping jaw (5) is controlled by a cam track, with a spring element (13) that generates the clamping force between the inner and outer clamping jaws (3 and 5). A book stop catch (30, 40) is carried on the book block clamp (1) for aligning the book block supplied by an infeed device. In order to reliably and flawlessly transfer and align the book blocks supplied by an infeed device, the book stop catch (30, 40) is arranged on the book block clamp (1) such that it can be moved relative to the inner clamping jaw (3). Only a small transport gap is required between two successively supplied book blocks such that the book block clamps (1) are able to transport a larger format height relative to the clamp pitch.

19 Claims, 2 Drawing Sheets

U.S. PATENT DOCUMENTS

| | | | | |
|---|---|---|---|---|
| 6,460,689 | B2 * | 10/2002 | Albrecht et al. | 198/735.3 |
| 6,607,070 | B2 * | 8/2003 | Brommer et al. | 198/621.1 |
| 7,121,540 | B2 * | 10/2006 | Machon et al. | 270/52.18 |
| 2004/0126219 | A1 * | 7/2004 | Mauz et al. | 414/790.2 |

FOREIGN PATENT DOCUMENTS

| | | | |
|---|---|---|---|
| DE | 27 25 416 | A1 | 12/1978 |
| DE | 31 07 458 | C2 | 9/1982 |
| DE | 32 07 102 | A1 | 9/1983 |

* cited by examiner

BOOK BLOCK TRANSPORT SYSTEM

BACKGROUND

The present invention pertains to a book block transport system with a plurality of book block clamps that can be continuously moved along a closed loop and are connected to one another in a motive fashion.

A book block transport system of this type is known from DE 31 07 458 C2. In this case, a book block supplied by an infeed device is aligned by a book stop catch that is stationarily arranged on the inner clamping jaw, wherein said book stop catch perpendicularly points away from the inner clamping jaw on the rear end and acts upon the rear edge of the book block. Since the position of the book stop catch is offset outward with respect to the track of the driving chain, it moves with a speed that is higher than the book block clamp speed in the deflection area between the delivery and the infeed of the transport system and practically plunges laterally into a transport gap between two book blocks successively supplied by the infeed device in order to approach the rear edge of the book block toward the end of the deflection area in the form of a pivoting movement of sorts and thusly transfer the book block from the conveyor of the infeed device.

In this case, it is disadvantageous that the book stop catch initially contacts the block part that faces the inner clamping jaw such that a corresponding shift of the layers within the book block can result, wherein such shifted layers can only be realigned by subjecting the layers to intensive vibrations over a certain transport section. The gap between two successively supplied book blocks required for the plunging movement of the book stop catch restricts the maximum format height with respect to the clamp pitch in the transport system. The pivoting movement of the book stop catch that begins in the delivery and takes place in advance relative to the book block also requires the timely downward release of the bound book block or brochure from the book block clamps.

SUMMARY

The present invention is based on the objective of developing a book block transport system with a plurality of book block clamps that can be continuously moved along a closed loop and are connected to one another in a motive fashion, wherein this book block transport system makes it possible to reliably transfer and align the book blocks supplied by an infeed device and only requires a small transport gap between two successively supplied book blocks.

According to the present disclosure, this objective is attained in that the book stop catch is arranged on the book block clamp such that it can be moved relative to the inner clamping jaw. In contrast to the stationary arrangement of the book stop catch on the inner clamping jaw in accordance with the state of the art, the movable arrangement makes it possible for the book stop catch to pivot or move between two successively transported book blocks in a space-saving fashion such that the transport gap can be reduced in order to increase the maximum format height with respect to the clamp pitch in the transport system. The thus far mandatory movement of the book stop catch with the inner clamping jaw that resulted in a pivoting movement with overspeed in the deflection area between the delivery and the infeed of the book block transport system no longer has negative effects on the transfer and the alignment of the book blocks supplied by the infeed device. The preferred embodiment for the first time makes it possible for the book stop catch to adjoin the rear edge of the book block over its entire product thickness such that the risk of layers shifting to one side is eliminated and a reliable and flawless transfer and alignment are ensured.

The book stop catch is preferably moved behind the book block to be transferred during or before the closing of the outer clamping jaw, essentially transverse to the supply direction of the book blocks. In one implementation, the book stop catch is moved away from the book block to be delivered along a straight transport section of the book block clamps when the outer clamping jaw is opened such that the book stop catch can no longer subject the book block to be delivered to an impermissible acceleration and the bound book blocks or brochures can be delivered level with the transport system in the form of a straight delivery.

The book stop catch is preferably movable, in essence, in a plane that extends perpendicular to the lower longitudinal clamping jaw edge, for example, in the form of a rotational movement about an axis that extends parallel to this longitudinal clamping jaw edge or a translational displacement of the book stop catch in this plane. The book stop catch can, in essence, be moved perpendicular to the inner clamping jaw.

According to another available feature, the travel or the length of the book stop catch is advantageously adjustable in dependence on the block thickness of the book block to be transferred. The book stop catch therefore is only as long as required with respect to the thickness of the book block. The required gap between two successively transported book blocks is additionally reduced due to the thusly shortened pivoting or insertion path of the book stop catch.

According to yet another available feature, the book stop catch has an overload safety for preventing damages to the book stop catch or the book block clamp and becomes effective if supply malfunctions occur, for example, malfunctions in which the book stop catch laterally contacts the book block.

According to one embodiment, the book stop catch is arranged on the outer clamping jaw that, as is generally known, is moved relative to the inner clamping jaw in order to open and close the book block clamp. The book stop catch can be fixed in a constructively simple fashion on the outer clamping jaw, wherein the outer clamping jaw is rotatably accommodated in the pivot frame. Additional means for moving the book stop catch are not required if the outer clamping jaw always assumes a parallel position relative to the inner clamping jaw during its opening and closing movements.

According to another embodiment, the book stop catch is arranged on the stationary inner clamping jaw such that it can be moved with the aid of control means. The control means preferably comprise a cam track that is arranged rigidly referred to the frame at one or more locations of the loop and is comparable to an opening and closing track for the pivot frame of the outer clamping jaw, wherein these measures result in a controlled, accurately timed movement of the book stop catch without requiring additional control elements such as sensors and/or electrically controlled actuators.

According to yet another embodiment, the book stop catch features aligning elements for a supplied cover, wherein the book stop catch with the aligning elements is positioned above the block spine until the cover is supplied.

BRIEF DESCRIPTION OF THE DRAWING

Embodiments of the invention are described in greater detail below with reference to the figures, wherein.

DESCRIPTION OF THE PREFERRED EMBODIMENT

Figure 1:
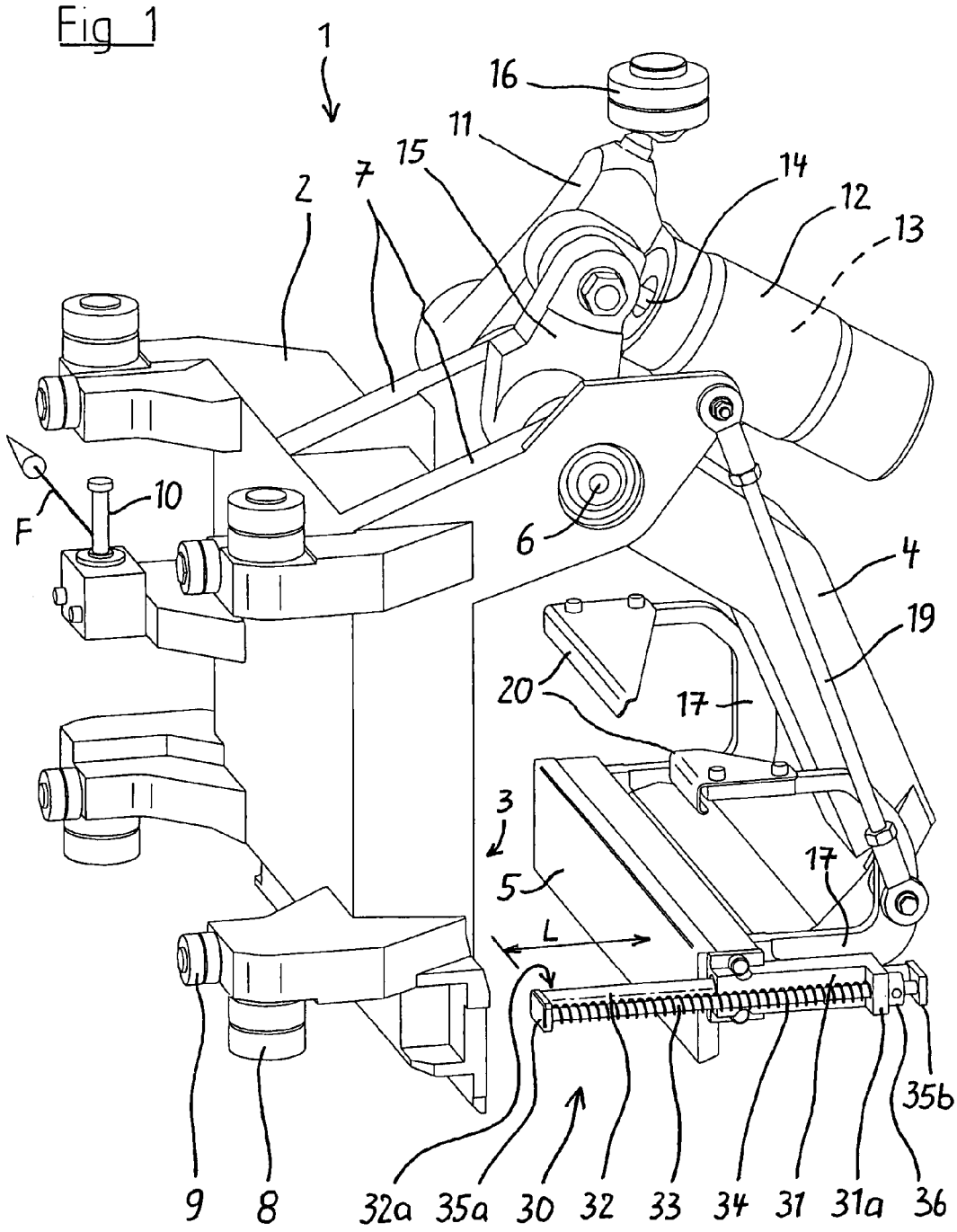
FIG. 1 is a perspective representation of a book block clamp with a book stop catch arranged on the outer clamping jaw.

The figures respectively show a book block clamp 1 of a transport system composed of a plurality of book block clamps 1 that are equidistantly spaced apart from one another and move continuously in a closed loop. The respective book block clamp 1 is essentially composed of a supporting frame 2 with a stationary inner clamping jaw 3 as well as a pivot frame 4 in the form of a pivot arm that is suspended on the supporting frame 2 and features an outer clamping jaw 5 rotatably supported thereon.

Several horizontal and vertical guide rollers 8 and 9 are arranged on the supporting frame 2 and can be displaced in a closed loop on not-shown guide rails. To this end, the frame 2 is coupled to a revolving, driven roller chain by means of a bolt 10, wherein said roller chain is symbolically indicated by an arrow that indicates the moving direction F.

The two extension arms 7 of the frame 2 rotatably support a shaft 6 that extends parallel to the lower longitudinal clamping jaw edge, wherein the pivot frame 4 is seated on this shaft in a non-rotatable fashion and a clamping force transmitting lever 11 is seated on said shaft in a rotatable fashion. A not-shown spring assembly 13 is compressible from both sides against the effect of the spring force, wherein said spring assembly is guided in a tubular receptacle part 12 of the lever 11 and situated between end stops and pressure plates.

The connection between the clamping force transmitting lever 11 and the pivot frame 4 with the outer clamping jaw 5 is realized with a connecting rod 14 that extends through the spring assembly 13 and is coupled in an articulated fashion to an extension arm 15 of the pivot frame 4 on one side and supported behind the spring assembly 13 on the other side.

The moving sequence for opening and closing the pivot frame 4 is realized with a not-shown two-dimensional cam with groove, into which engages a roll-type follower 16 that is held on the end of the clamping force transmitting lever 11 and can be pivoted transverse to the moving direction F. The book block clamp 1 reaches the infeed region of a book binding machine with the outer clamping jaw 5 in the lowered position, wherein the clamping force transmitting lever 11 transfers the pivot frame 4 with the outer clamping jaw 5 into the closed position in accordance with the progression of the cam with groove. A book block transported between the two clamping jaws 3 and 5 is taken hold of by the book block clamp 1 in that the clamping force is transmitted from the cam with groove to the extension arm 15 of the pivot frame 4 by means of the lever 11, the spring assembly 13 and the connecting rod 14.

The clamping displacement of the lever 11 in the cam with groove is always identical regardless of the block thickness, wherein the spring deflection of the spring assembly 13 that has a decreasing characteristic increases with the block thickness. At the end of the clamping displacement, the force transmitting lever 11 is held in the above-described closed position by means of a not-shown interlocking arrangement such that the clamping force no longer has to be exerted by the cam with groove and the roll-type follower 16 is released from the cam with groove. With respect to the design and function of the interlocking arrangement, reference is made to DE 31 07 458 C2.

The interlocking arrangement remains functional until the roll-type follower 16 once again runs into the cam with groove in order to release the book block. The book block clamp 1 is unlocked and the clamping force transmitting lever 11 that is controlled by the cam with groove moves the pivot frame 4 with the outer clamping jaw 5 into the outwardly pivoted open position.

As initially mentioned, the outer clamping jaw 5 is rotatably supported on the pivot frame 4. Connecting rods 17 fixed on the clamping jaw 5 are coupled to both sides of the pivot frame 4 in pivot bearings 18 for this purpose. A four-bar mechanism is formed by means of a coupling rod 19 that engages on one of the two connecting rods 17 in an articulated fashion and is connected to one extension arm 7 of the supporting frame 2 in an articulated fashion with its other end, namely such that the outer clamping jaw 5 is always guided parallel to the inner clamping jaw 3. The connecting rods 17 feature an extension, on which a supporting plate 20 is mounted in order to support the clamped book block.

According to a first embodiment of the invention that is illustrated in FIG. 1, a book stop catch 30 is fixed on the outer clamping jaw 5 and consequently moved with the closing movement thereof, i.e., it is always oriented horizontally or perpendicular to the inner clamping jaw 3, respectively.

The book stop catch 30 is essentially composed of a guide 31 that is laterally fixed on the outer clamping jaw 5 and in which a rod 32 is displaceably guided, wherein said guide features a stop 31*a*, in which an additional guide rod 33 is guided that is connected to the rod 32 by means of additional brackets 35*a, b* and serves as an antitwisting device for the rod 32. On its side that faces the book block to be aligned, the rod 32 features a plane stopping face 32*a* that serves as the actual book stop catch.

The rod 32 is held in an extended position with the stopping face 32*a* by means of a pressure spring 34 that is guided on the guide rod 33 and supported on the stop 31*a* with one end and on the front bracket 35*a* with the other end, wherein the effective length L of the book stop catch 30 can be adjusted in dependence on the book block thickness by displacing an adjusting ring 36 seated on the guide rod 33. When an obstacle is encountered, for example, an incorrectly supplied book block, the axle 32 yields against the pressure of the spring 34 and thusly performs the function of an overload safety.

The progression of the cam with groove for controlling the clamping force transmitting lever 11 and for closing the outer clamping jaw 5 is realized such that the book stop catch 30 is not moved behind the book block to be transferred until the clamping jaws 3, 5 of the book block clamp 1 essentially lie parallel to the supply direction of the book blocks. The book block supplied at a slower speed is then transferred to the supply conveyor of the infeed device and aligned by the book stop catch 30 in a phase in which the clamping jaws 3 and 5 do not yet take hold of the book block, wherein the stopping face 32*a* of the book stop catch 30 adjoins the rear edge of the book block from the beginning over the entire product thickness.

Figure 2:
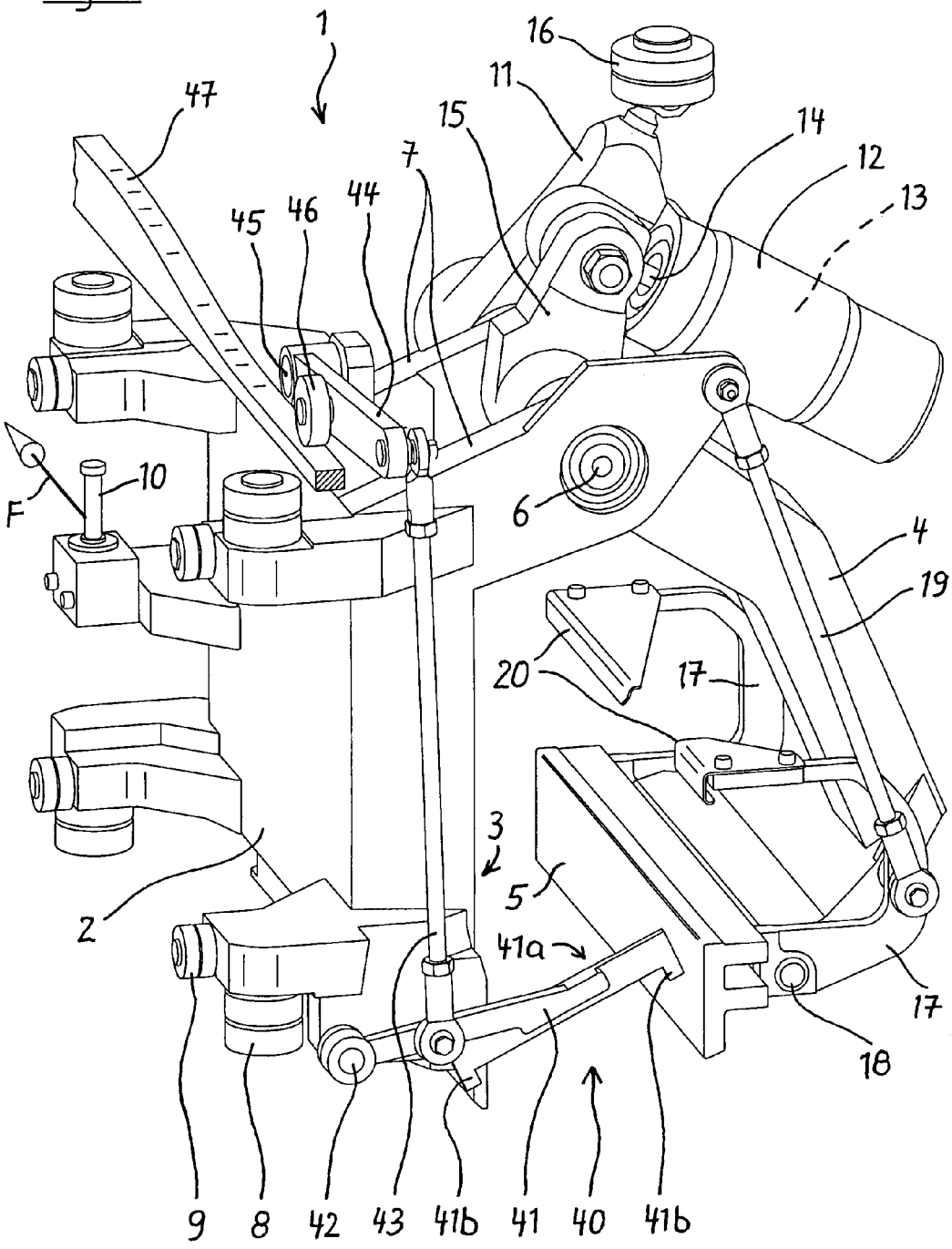
FIG. 2 is an identical representation of a book block clamp with a book stop catch that is arranged on the inner clamping jaw in a pivoting fashion.

FIG. 2 shows a second embodiment of the invention. This embodiment features a book stop catch 40 in the form of a lever 41 with a block stopping face 41*a* that is supported on the supporting frame 2 and on the inner stationary clamping jaw 3, respectively, such that it is rotatable about an axis of rotation 42 extending parallel to the lower longitudinal clamping jaw edge, wherein a control lever 44 pivots said lever back and forth into a position behind the supporting frame 2 and an aligning position that is shown in FIG. 2 via a coupling rod 43 such that it essentially points perpendicularly away from the clamping jaw 3.

To this end, the control lever 44 that is supported on the supporting frame 2 and can be pivoted about the pivoting axis

45 features a cam roller 46 that rolls in a cam track 47 arranged rigidly referred to the frame. An overload safety is realized in that the control lever 44 with its cam roller 46 is able to lift off the cam track 47 in case the lever 41 collides with a foreign object.

On its edge that points downward, the lever 41 features protruding brackets that serve as cover stops 41*b* for aligning a cover that is supplied to the book block clamped in the book block clamp 1 after the processing and gluing of the book block spine in order to be pressed against the spine and the lateral surfaces near the spine. In order to align the book block, the lever 41 is situated in a slightly raised position as shown in FIG. 2. The lever 41 is not moved into the additionally lowered position such that the cover stops 41*b* extend into the transport plane of the cover until of the cover supply device is reached.

In both embodiments the book stop catch 30 or 40 can be moved away from the finished, bound book block to be delivered along a straight transport section of the book block clamps 1 when the outer clamping jaw 5 opens, namely such that the book stop catch 30 or 40 lies outside the linear transport path of the book block in the deflection area of the book block clamps 1. The bound book blocks or brochures can be delivered level with the transport system of the book block clamps 1 in the form of a straight delivery.

The invention claimed is:

1. A book block transport system with a plurality of book block clamps that can be continuously moved along a closed loop and are connected to one another in a motive fashion, said clamps comprising:

a supporting frame that is supported in guides associated with said loop and carries an inner clamping jaw;

a pivot frame that is suspended on a shaft of the supporting frame extending parallel thereto and accommodating a pivotable, outer clamping jaw, wherein the pivoting movement for opening and closing the outer clamping jaw is controlled by a cam track associated with said loop;

a spring element that generates a clamping force between the inner and outer clamping jaws; and a book stop catch on the book block clamp for aligning the book block supplied by an infeed device;

wherein the book stop catch is moveable relative to the inner clamping jaw.

2. The book block transport system according to claim 1, wherein the book stop catch is moveable transverse to the feed direction of the book blocks during or before the closing of the outer clamping jaw.

3. The book block transport system according to claim 2, wherein the book stop catch is moveable away from the book block to be fed along a straight transport section of the book block clamps during the opening of the outer clamping jaw.

4. The book block transport system according to claim 2, wherein at least one jaw has a lower longitudinal edge and the book stop catch is moveable in a plane that extends perpendicular to the lower longitudinal edge.

5. The book block transport system according to claim 2, wherein the book stop catch is arranged on the outer clamping jaw.

6. The book block transport system according to claim 5, wherein the book stop catch is fixed on an outer clamping jaw that is accommodated in the pivot frame.

7. The book block transport system according to claim 2, wherein the book stop catch is arranged on the inner clamping jaw and is moveable with the aid of a controller.

8. The book block transport system according to claim 1, wherein the book stop catch is moveable away from the book block to be fed along a straight transport section of the book block clamps during the opening of the outer clamping jaw.

9. The book block transport system according to claim 8, wherein at least one jaw has a lower longitudinal edge and the book stop catch is moveable in a plane that extends perpendicular to the lower longitudinal edge.

10. The book block transport system according to claim 1, wherein at least one jaw has a lower longitudinal edge and the book stop catch is moveable in a plane that extends perpendicular to the lower longitudinal edge.

11. The book block transport system according to claim 10, wherein the book stop catch is moveable perpendicular to the inner clamping jaw.

12. The book block transport system according to claim 11, wherein the movement travel or the length (L) of the book stop catch is adjustable in dependence on the block thickness of the book block to be fed.

13. The book block transport system according to claim 10, wherein the movement travel or the length (L) of the book stop catch is adjustable in dependence on the block thickness of the book block to be fed.

14. The book block transport system according to claim 1, wherein the book stop catch features an overload safety.

15. The book block transport system according to claim 1, wherein the book stop catch is arranged on the outer clamping jaw.

16. The book block transport system according to claim 15, wherein the book stop catch is fixed on an outer clamping jaw that is accommodated in the pivot frame.

17. The book block transport system according to claim 1, wherein the book stop catch is arranged on the inner clamping jaw and is moveable with the aid of a controller.

18. The book block transport system according to claim 17, wherein the controller comprise a cam track that is arranged rigidly relative to the frame at one or more locations of the loop.

19. The book block transport system according to claim 1, wherein the book stop catch features aligning elements for a supplied cover, wherein the book stop catch with the aligning elements is positioned above the block spine until the cover supply is reached.

* * * * *